US005588497A

United States Patent [19]

Thorburn

[11] Patent Number: 5,588,497

[45] Date of Patent: Dec. 31, 1996

[54] MOUNTING DRILL BUTTONS

[75] Inventor: Peter R. Thorburn, Welkom, South Africa

[73] Assignee: Galison Drilling (Proprietary) Limited, Welkom, South Africa

[21] Appl. No.: 388,457

[22] Filed: Feb. 14, 1995

[51] Int. Cl.[6] ..... E21B 10/52; E21B 10/56; E21B 10/62

[52] U.S. Cl. ..... 175/420.1; 175/426; 175/413; 29/525

[58] Field of Search ..... 175/426, 420.1, 175/374, 428, 412, 413; 29/525

[56] References Cited

U.S. PATENT DOCUMENTS

| | | | |
|---|---|---|---|
| 2,097,030 | 10/1937 | Killgore | 175/426 |
| 2,121,202 | 6/1938 | Killgore | 175/374 |
| 2,161,062 | 6/1939 | Killgore | 175/420.1 X |
| 4,014,395 | 3/1977 | Pearson . | |
| 4,109,737 | 8/1978 | Bovenkerk . | |
| 4,334,586 | 6/1982 | Schumacher | 175/374 |
| 4,598,779 | 7/1986 | Liljekvist et al. | 175/426 |
| 4,607,712 | 8/1986 | Larsson | 175/426 |
| 5,220,967 | 6/1993 | Monyak | 175/420.1 |

*Primary Examiner*—Stephen J. Novosad
*Attorney, Agent, or Firm*—Birch, Stewart, Kolasch & Birch, LLP

[57] ABSTRACT

A method of mounting a hard insert in a cutting tool such as a drill bit is disclosed. The insert has a head and a shank which tapers inwardly in a direction away from the head of the insert. The cutting tool body has several seats which are shaped and tapered complementally to the insert shank. The insert is pressed or tapped into the seat so that the insert shank engages the seat in the tool in a friction fit. The insert shank may be frustoconical, or, alternatively, polygonal or irregular in shape. The taper of the shank (and the complemental taper of the seat) should be relatively shallow, with an included angle in the range of 4° to 14°. Preferably, the included angle of the shank should be slightly greater than that of the seat.

16 Claims, 2 Drawing Sheets

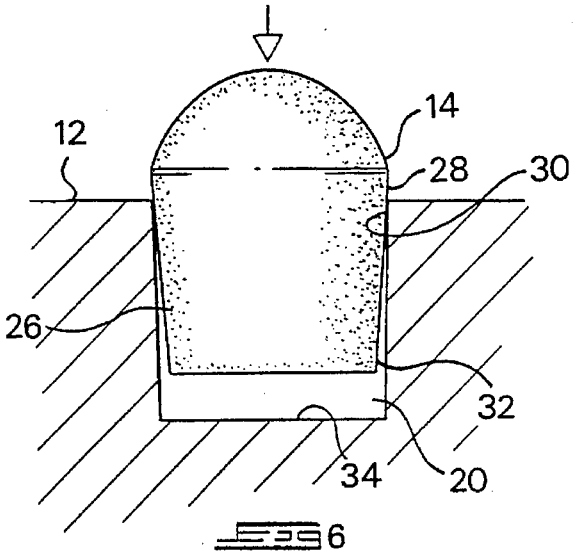
5a
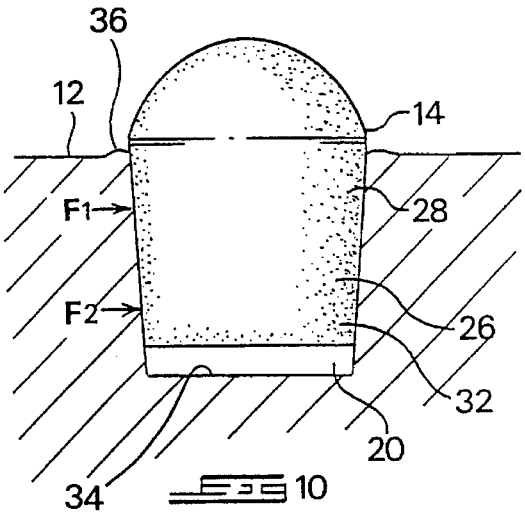
5b
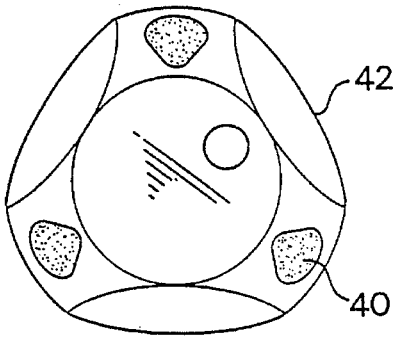
6
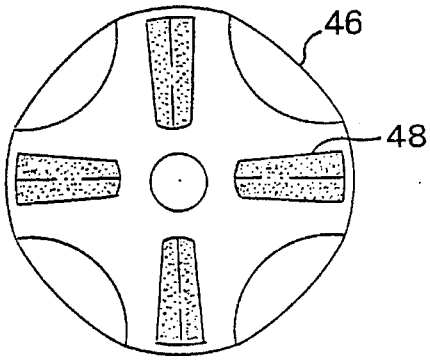
10
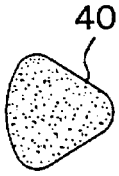
7
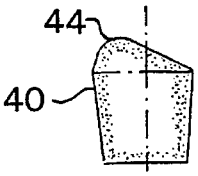
8
9
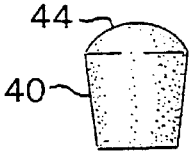
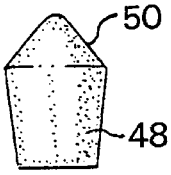
13
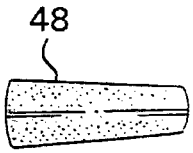
11
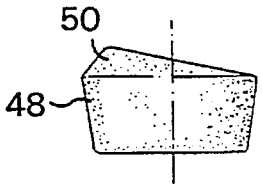
12

MOUNTING DRILL BUTTONS

BACKGROUND OF THE INVENTION

1. Field of the Invention

THIS invention relates to a method of mounting a hard insert such as a button in a cutting tool such as a drill bit and to a cutting tool formed by the method.

2. Description of Background Art

Various kinds of drill bits and other cutting tools are known in which hard buttons of tungsten carbide or other hard material are mounted in order to increase the durability of the bits. For example, knock-off drill bits which are intended to fit onto the tapered end of a drill rod generally comprise a cup-shaped body which defines a tapered, generally frusto-conical socket which fits onto the end of the drill rod, and have several hard buttons mounted in seats in a head portion of the body.

It is conventional to mount the buttons in their seats by brazing. In this case, the buttons are made somewhat smaller than the seats. It is also known to heat shrink the buttons into their seats. In this case, the buttons are sized exactly with respect to their seats. The drill bit is heated, the buttons are inserted into their seats, and the drill bit is cooled, so that the buttons are held firmly in their seats.

It is an object of the invention to provide an alternative method of mounting buttons in a drill bit.

SUMMARY OF THE INVENTION

According to the invention a method of mounting a hard insert in a cutting tool comprises the steps of:

providing a hard insert having a head and a tapered shank;

providing a curing tool having a body defining at least one seat shaped and tapered complementally to the shank of the insert, the seat having an inner end, an outer end and an upstanding side wall extending between the inner and outer ends; and urging the insert into the seat so that the shank of the insert engages the side wall of the seat in a friction fit, with the end of the shank clear of the inner end of the seat.

The insert may be pressed or tapped into the seat.

The seat may be formed in the body of the curing tool by machining, or it may be formed integrally with the body of the cutting tool in a casting process.

Preferably, both the shank of the hard insert and the side wall of the seat are tapered conically, with the cone angle of the shank being greater than that of the side wall, so that when the insert is urged into the seat sufficiently far that the lower end of the shank contacts the side wall of the seat adjacent the inner end of the seat, the material of the cutting tool body is deformed outwardly at the upper edge of the seat by the upper end of the shank.

Further according to the invention a cutting tool comprises:

a body defining at least one seat, the seat having an inner end, an outer end and an upstanding side wall extending between the inner and outer ends; and a hard insert having a head and a tapered shank retained in the at least one seat;

the seat being shaped and tapered complementally to the shank of the hard insert so that the shank of the insert engages the sidewall of the seat in a friction fit, with the end of the shank clear of the inner end of the seat.

The shank of the hard insert may be frusto-conical in shape and may taper inwardly in a direction away from the head of the insert.

Alternatively, the shank of the hard insert may be polygonally or irregularly shaped in section and taper inwardly in a direction away from the head of the insert.

Preferably, both the shank of the hard insert and the side wall of the seat are tapered conically, with the cone angle of the shank being equal to or greater than that of the side wall.

The difference between the cone angles of the shank and the side wall is preferably in the range 0° to 2° and typically approximately 1°.

The cone angle of the shank may be in the range of 4° to 14°.

A bore may extend between the inner end of the seat and a cavity in the body of the cutting tool, so that the cutting insert can be removed from the seat by inserting a suitable tool through the bore via the cavity.

In one embodiment of the invention, the head of the cutting insert may be asymmetrical about a central plane.

Where the cutting tool is a drill bit, a plurality of such cutting inserts may be disposed about an axis of rotation of the drill bit so that a relatively larger portion of the head of each cutting insert is disposed radially outermost.

The cutting insert may be formed by casting or sintering and mounted in the seat as cast or sintered.

The seat in the cutting tool may be formed by machining, or the cutting tool and the seat may be formed by casting.

BRIEF DESCRIPTION OF THE DRAWINGS

FIGS. 5*a* and 5*b* are diagrammatic side views of a button prior to insertion into its seat and after insertion, respectively;

FIG. 6 is a plan view of an alternative embodiment of a knock-off drill bit according to the invention having triangular buttons;

FIGS. 7, 8 and 9 view, are a plan view, a first side view and a second side respectively, of a button of the drill bit of FIG. 6;

FIG. 10 is a plan view of another embodiment of a knock-off drill bit according to the invention; and FIGS. 11, 12 and 13 are a plan view, a first side view and a second side view, respectively, of a button of the drill bit of FIG. 8.

DESCRIPTION OF EMBODIMENTS

Figure 1:
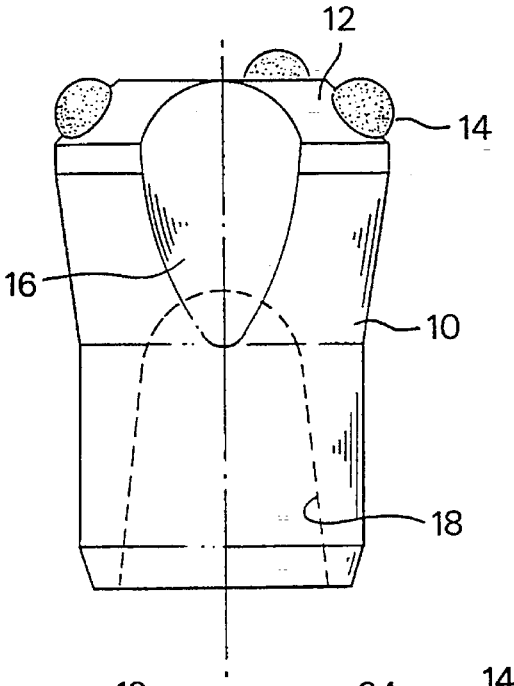
FIG. 1 is a side view of a knock-off drill bit fitted with hard buttons according to the method of the invention.

Referring first to FIG. 1, a knock-off drill bit is shown which comprises a cast or machined cup-shaped body 10 with a cutting head 12 in which a number of tungsten carbide buttons 14 are embedded. Spaced about the circumference of the head 12 between the buttons 14, and extending in the direction of the axis of the drill bit, are flutes 16. A tapered frusto-conical socket 18 is defined at the other end of the body 10 which is shaped to receive the tapered end of a drill rod with a friction fit.

Knock-off drill bits of the kind illustrated are typically used in drilling charge holes in hard rock, with a rotary percussive action. This generates axial forces which tend to force the buttons downwardly into their seats. However, it has been found that the buttons in the drill bits of the invention are retained sufficiently firmly to make them suitable for non-percussive rotary drilling as well.

Figure 2:
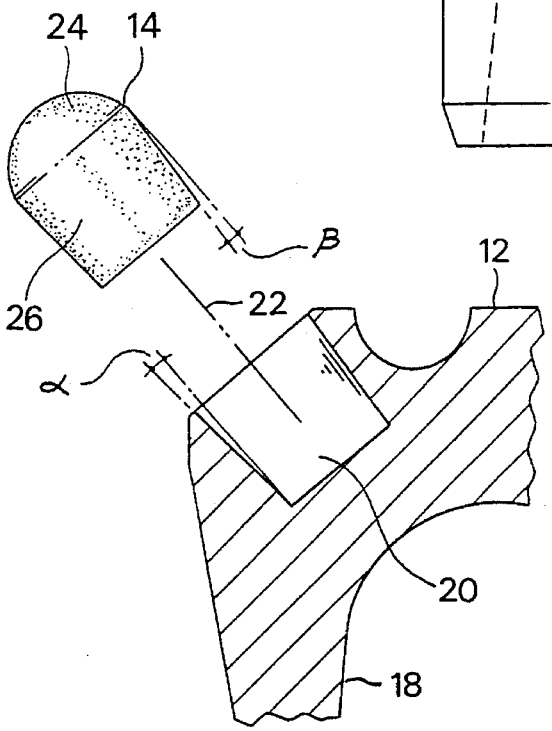
FIG. 2 is a partial sectional exploded side view of a button and a seat of the drill bit of FIG. 1.

FIG. 2 is a sectional side view through a seat in the head of the drill bit of FIG. 1. The seat 20 is a frusto-conical socket which tapers inwardly towards its inner end. Such a seat can be formed, for example, when the body is cast, or by machining. As shown, the side wall of the seat is tapered outwardly from the bottom thereof at an angle $\alpha$ relative to the longitudinal axis 22 of the seat, so that the cone angle of the side wall (i.e. the included angle defined thereby) is $2\alpha$.

Shown adjacent to the seat 20 is a cast tungsten carbide button 14 which has a hemispherical head 24 and a tapered, frusto-conical shank 26. The shank of the button is tapered inwardly towards the end thereof which is remote from the head 24, at an angle $\beta$ relative to the longitudinal axis of the button, so that the cone angle of the shank is $2\beta$. The angles $\alpha$ and $\beta$ are approximately equal, as discussed in more detail below.

The tapers of the shank and the seat are complemental, in the sense that they are intended to allow frictional engagement of the shank with the seat. Thus, the word "complemental" is not used in a strict geometric sense in this specification, but to indicate that the tapers of the shank and seat are sufficiently similar for frictional retention of the shank in the seat, as described herein.

Figure 3:
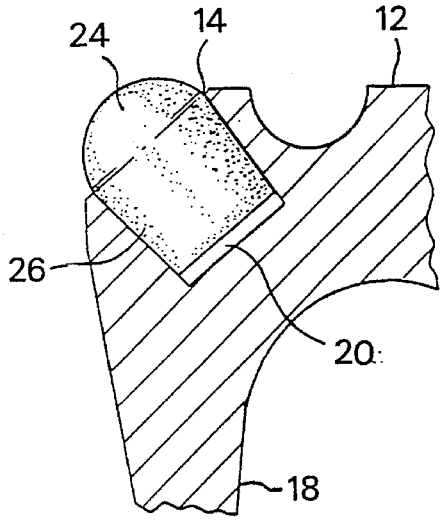
FIG. 3 is a similar view to that of FIG. 2, showing the button in its seat.

FIG. 3 shows the button 14 mounted in the seat 20, with the extreme end of the shank 26 just clear of the bottom of the seat. The matching shallow tapers of the button and the seat result in a secure friction fit between the button shank and the wall of the seat, effectively resulting in a self-locking action when the button is pressed, tapped or otherwise urged into the seat. It is important that the end of the shank 26 remain clear of the base of the seat 20 when the button is mounted therein. The clearance allows the button to be forced deeper into the seat in use, due to axial forces acting on the button, particularly due to percussive forces on the drill bit. If the end of the shank were to contact the base of the seat, such axial movement of the button would no longer be possible, and the radial forces acting on the button head would tend to loosen the button in the seat.

If the angles $\alpha$ and $\beta$ are exactly equal, the contact between the shank of the button and the wall of the seat will be uniform, and contact stresses in the material of the body around the seat will be uniformly distributed. However, due to tolerances in the manufacture of the button and the seat, an exact match between the cone angles of the button and the seat is not likely in practice. Experiments have shown that if the cone angle of the seat is even slightly greater than that of the button shank (0.25° or more), retention of the button in the seat is adversely affected. In such a case, the contact force between the button shank and the seat is concentrated towards the end of the shank and the base of the seat, while the upper end of the shank adjacent to the head of the button is held less securely in the seat. This allows some radial movement of the button head in use, which tends to loosen the button in the seat.

By contrast, if the cone angle of the button shank is slightly greater than that of the seat, the contact force between the button shank and the seat is concentrated towards the upper end of the seat and the upper portion of the shank adjacent the head of the button. The material of the drill bit body at the outer edge of the seat can spall or deform slightly as the button is forced into its seat, so that the button shank ultimately is in contact with the wall of the seat along most or all of its length, with the contact force between the shank and the seat increasing towards the upper end of the seat.

The above effect is illustrated diagrammatically in FIGS. 5*a* and 5*b*. In FIG. 5*a*, a button 14 is shown partially inserted into a seat 20. The button shank 26 has a cone angle which is somewhat greater than that of the seat 20. (The difference is exaggerated in the figure, for clarity). As a result, the upper end 28 of the button shank makes contact with the outer edge 30 of the seat while the other end 32 of the button shank is still clear of the wall of the seat adjacent the base 34 of the seat.

When the button is forced axially into the seat in the direction of the arrow in FIG. 5*a*, the material 36 of the drill bit body 12 adjacent the periphery of the seat 20 deforms slightly (shown in an exaggerated manner in FIG. 5*b*) to accommodate the upper end 28 of the shank, while the lower end 32 of the shank eventually comes into contact with the side wall of the seat 20 adjacent its base 34. As a result, the contact force $F_1$ between the button shank and the seat towards the upper end of the seat is greater than the corresponding force $F_2$ towards the base of the seat.

The angles $\alpha$ and $\beta$ will vary in use according to the materials selected for the button and the drill bit body and the geometry of the buttons and their seats. Tests have indicated that the cone angle of the button shank should be within the range of 4° to 14°, with an optimum in the region of 8° (i.e. $\beta$=4°). The cone angle of the seat should be approximately 1° less than that of the shank, so that when $\beta$=4°, $\alpha$=3.5° in the given example. The difference between $\alpha$ and $\beta$ can vary somewhat, according to the methods used to form the buttons and the seats. When both the buttons and the drill bits with their seats are formed by casting, a difference of 1° in the cone angles of the button shank and the seat accommodates the resulting tolerances.

Tests on drill bits with buttons inserted by the above method showed that it was not necessary to use great force in pressing or tapping the buttons into their seats to ensure their retention in use. For example, a force of as little as 300N is adequate in the case of rotary-percussion drill bits.

Figure 4:
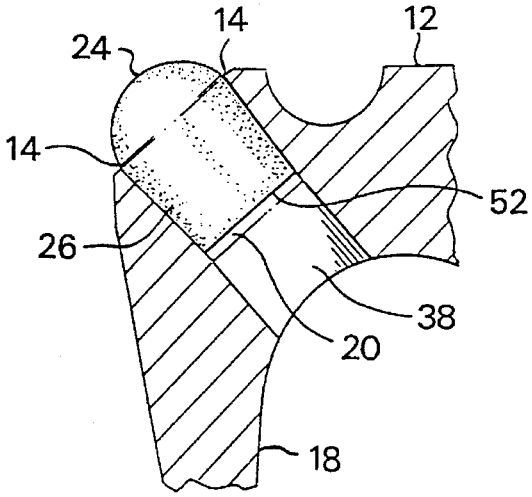
FIG. 4 is a partial sectional side view of an alternative embodiment of the invention.

FIG. 4 shows an embodiment of the invention which is similar to that of FIGS. 2 and 3, but in which the seat 20 is not a blind hole in the drill bit body, but has a bore 38 which extends from the base of the seat through to the interior of the socket 18. The bore 38 provides access to the base 52 of the button 14, so that the button can be forced out of its seat with a suitable tool and replaced to recondition the drill bit. This feature can be advantageous in the case of larger bits or cutters which are expensive to replace.

FIG. 6 shows an alternative embodiment of the invention, in which three buttons 40 which are generally triangular in plan are mounted in a knock-off drill bit 42. FIG. 7 shows a button 40 in plan, while FIGS. 8 and 9 show first and second side views of the button. The button has a head 44 which is asymmetrical about a central plane X—X, so that the bulk of the material of the head is disposed radially outwardly as far as possible on the drill bit with the button oriented as shown.

Although the button 40 is not circular in section, its shank is tapered conically at the same angle as the above described buttons, and the seats in the drill bit body 42 are shaped complementally.

FIG. 10 shows a further embodiment of the invention, in which the buttons of the drill bit 46 are arranged in a cruciform configuration. This embodiment of the invention has elongated inserts 48, one of which is shown in plan in FIG. 11 and in first and second side views in FIGS. 12 and 13. The button has an asymmetrically shaped head 50. Again, the shank of the button 48 has an irregular shape in cross-section, but the shank is tapered complementally to a seat formed in the body of the drill bit 46.

Particularly where irregularly shaped buttons are used, it is advantageous to form the seats for the buttons when the drill bit body is formed by casting. However, in the case of cylindrically tapered buttons, the seats can be formed by drilling. Obviously, forming the seats integrally when the drill bit body is cast is time and labour-saving.

By choosing a suitable shallow taper, a positive self-locking action between the buttons and their seats is obtained by the friction fit between them, which obviates the need to braze the buttons into position, or to carry out a heat shrinking process. Surprisingly, buttons mounted in the described manner are retained firmly in use, even in non-percussive drilling applications.

Although the invention has been described with reference to a knock-off drill bit, it will be appreciated that the invention is not limited to such drill bits, or even to drill bits generally, but can be applied to various cutting tools where a hard cutting insert or button is fitted into a seat formed in the body of a cutting tool.

I claim:

1. A method of mounting a hard insert in a cutting tool comprising the steps of:

providing a hard insert having a head and a tapered shank;

providing a cutting tool having a body defining at least one seat shaped and tapered complementally to the shank of the insert, the seat having an inner end, an outer end and an upstanding sidewall extending between the inner and outer ends; and urging the insert into the seat so that the shank of the insert engages the sidewall of the seat in a friction fit, with the end of the shank clear of the inner end of the seat;

wherein both the shank of the hard insert and the sidewall of the seat are tapered conically, with the cone angle of the shank being greater than that of the sidewall, so that when the insert is urged into the seat sufficiently far that the lower end of the shank contacts the sidewall of the seat adjacent the inner end of the seat, the material of the cutting tool body is deformed outwardly at the upper edge of the seat by the upper end of the shank.

2. The method of mounting a hard insert in a cutting tool according to claim 1, wherein the insert is pressed or tapped into the seat.

3. The method of mounting a hard insert in a drill bit according to claim 1, including the step of forming the seat in the body of the cutting tool by machining.

4. The method of mounting a hard insert in a cutting tool according to claim 1, including the step of forming the seat integrally with the body of the cutting tool in a casting process.

5. A cutting tool comprising:

a body defining at least one seat, the seat having an inner end, an outer end and an upstanding sidewall extending between the inner and outer ends; and a hard insert having a head and a tapered shank retained in the at least one seat;

the seat being shaped and tapered complementally to the shank of the hard insert so that the shank of the insert engages the sidewall of the seat in a friction fit, with the end of the shank clear of the inner end of the seat, wherein both the shank of the hard insert and the sidewall of the seat are tapered conically, with the cone angle of the shank being greater than that of the sidewall.

6. The cutting tool according to claim 5, wherein the shank of the hard insert is frusto-conical in shape and tapers inwardly in a direction away from the head of the insert.

7. The cutting tool according to claim 5, wherein the shank of the hard insert is polygonally or irregularly shaped in section and tapers inwardly in a direction away from the head of the insert.

8. The cutting tool according to claim 5, wherein the difference between the cone angles of the shank and the sidewall is between 0° to 2°.

9. The cutting tool according to claim 8, wherein the difference is approximately 1°.

10. The cutting tool according to claim 5, wherein the cone angle of the shank is in the range of 4° to 14°.

11. The cutting tool according to claim 5, wherein a bore extends between the inner end of the seat and a cavity in the body of the cutting tool, so that the cutting insert can be removed from the seat by inserting a suitable tool through the bore via the cavity.

12. The cutting tool according to claim 5, wherein the head of the cutting insert is asymmetrical about a central plane.

13. The cutting tool according to claim 12, wherein the cutting tool is a drill bit, a plurality of the cutting inserts being disposed about an axis of rotation of the drill bit so that a relatively larger portion of the head of each cutting insert is disposed radially outermost.

14. The cutting tool according to claim 5, wherein the cutting insert is formed by casting or sintering and mounted in the seat as cast or sintered.

15. The cutting tool according to claim 5, wherein the seat in the cutting tool is formed by machining.

16. The cutting tool according to claim 5, wherein the cutting tool and the seat are formed by casting.

* * * * *